US005377573A

United States Patent [19]

Tretick

[11] Patent Number: 5,377,573

[45] Date of Patent: Jan. 3, 1995

[54] SHOULDER PAD FOR VIOLIN AND VIOLA

[76] Inventor: Stephanie Tretick, 3979 Boulevard Dr., Pittsburgh, Pa. 15217

[21] Appl. No.: 204,869

[22] Filed: Mar. 2, 1994

[51] Int. Cl.[6] ..... G10D 1/02

[52] U.S. Cl. ..... 84/280; 84/327

[58] Field of Search ..... 84/278, 280, 327

[56] References Cited

U.S. PATENT DOCUMENTS

| | | | |
|---|---|---|---|
| 2,524,526 | 10/1950 | Hines | 84/280 |
| 3,479,916 | 11/1969 | Wolf | 84/280 |
| 3,631,754 | 1/1972 | Kun | 84/280 |
| 3,690,211 | 10/1972 | Long | 84/280 |
| 3,896,694 | 7/1975 | Goldner | 84/280 |
| 4,212,222 | 7/1980 | Henkle | 84/278 |
| 4,506,582 | 3/1985 | Goldner | 84/280 |
| 4,951,541 | 8/1990 | McMillan | 84/280 |

OTHER PUBLICATIONS

Shar Products Fall '93 Catalogue, Shar Products Company, front cover, p. 1610, back cover dated Aug. 5, 1993.

*Primary Examiner*—Michael L. Gellner
*Assistant Examiner*—Patrick J. Stanzione
*Attorney, Agent, or Firm*—Buchanan Ingersoll

[57] ABSTRACT

In a shoulder support for violin or other stringed instrument an inelastic filament loop passes through a pair of longitudinal channels in a foam pad and is looped through an elastic band, The filament loop is fitted over the end button on the instrument and the elastic band may be fitted over the lower bout corner on the bass-bar side of the instrument. When so placed the filament loop will press the pad against the back of the instrument and the portions of the filament within the longitudinal channels of the foam pad will be forced toward one another thereby compressing a portion of the foam pad between the longitudinal channels. Consequently, the pad will be held in place during normal use of the instruments.

16 Claims, 2 Drawing Sheets

SHOULDER PAD FOR VIOLIN AND VIOLA

BACKGROUND OF THE INVENTION

Field of the Invention

The invention relates to a support positioned between a violin or a viola and the performer's shoulder.

BRIEF DESCRIPTION OF THE PRIOR ART

A prerequisite to playing a string instrument held at the neck such as violin or viola, is a secure playing position of the instrument. A player must be able to grip the instrument with his or her head and shoulder. A variety of shoulder supports have been and are available in numerous forms and configurations ranging from simple resilient pads to complicated rigid bars that are mounted across the back of the instrument. For example, U.S. Pat. Nos. 3,896,694 and 4,506,582 disclose inflatable bodies which are fitted over the back of the instrument. This type of device has been sold under the trademark "Playonair". The Playonair support tends to slip and may fall off the back of the instrument. Because the device has an air-filled bladder, the bladder must be inflated prior to use. The bladder can leak which is particularly discomforting when the leak occurs during a performance.

There have also been a variety of supports which comprise rigid bars or other structures made of hard material such as metal and hard plastics which may be padded on the surface which rests against the shoulder. Examples of such devices are disclosed in U.S. Pat. Nos. 3,479,916, 3,361,754 and 4,212,222. Because the supports can damage the fragile wood of the instruments, they are also undesirable. Most of these supports are also large and bulky, making it difficult for a player to find a place inside the instrument case to store the support. These larger types of supports, being of unyielding materials, may also pose a hazard to the player, causing fixed and unnatural playing positions that can lead to neck and back problems for the player. They are also commonly rather heavy which adds to the weight of the instrument. Such additional weight is a detriment to players who have the instrument in a playing position many hours a day. Players frequently in the public eye must also consider the esthetics of the shoulder support they use. Many of these supports are unsightly and distracting to the audience.

Yet another support is a simple D-shaped cloth covered rubber pad on a leather strap. Like the Playonair support, this device also tends to slip against the back of the instrument. The pad may also slip along the leather strap while the instrument is being played. Furthermore, the leather strap is often too thick to remain attached to the end button of the instrument.

The art has also utilized simple foam pads attached to the instrument with a rubber band. This type of arrangement also tends to slip or work loose while the instrument is being played.

Thus, there, is a need for a shoulder support for stringed instruments which is comfortable, will remain in place and is not distracting to the audience.

SUMMARY OF THE INVENTION

I provide a shoulder support for violin and other instruments comprised of a foam pad having a pair of substantially parallel longitudinal channels therethrough. The pad is made from a resilient foam material which when placed on a violin will have a coefficient of friction sufficient so that the pad will remain in place during normal use. An inelastic filament loop passes through the channels in the foam pad and an elastic band is linked around one end of the filament loop.

The shoulder support is placed on the instrument by fitting one end of the filament loop around the end button on the instrument. The elastic band encircling the opposite end of the filament loop is then fitted over the lower bout corner on the bass-bar side of the instrument. When so placed the filament loop will press the pad against the back of the instrument and the portions of the filament pad within the longitudinal bores of the foam pad will be forced toward one another. This action inhibits the foam pad from moving along the filament loop.

The foam pad is preferably comprised of a substantially open cell foam, The pad can be made in any desired thickness, However, I prefer a thickness of between 0,25 and 1 inch. The filament loop is preferably made from a monofilament fishing line having a rating of at least 30 pounds.

Other objects and advantages of the present invention will become apparent from the description of the preferred embodiments thereof shown in the figures.

DESCRIPTION OF THE PREFERRED EMBODIMENTS

Violins and violas are are well-known musical instruments which have a similar shape, At the bottom of the instrument there is a protruding peg, called an end button. The end button anchors the entire string structure on the top of the instrument and is one of the attachment points for the present invention. The sidewall of the stringed instrument is called the bout. There is an interior structural member of a stringed instrument called the bass-bar which is positioned substantially parallel to the strings of the instrument. The term "bass-bar" is also used to reference the low sounding, or left hand side of the instrument, as one looks at the instrument from the top, because the bass-bar traditionally occurs on this side of the instrument. The present invention is designed to be secured between the end button and the lower bout corner on the bass-bar side of the instrument.

Figure 1:
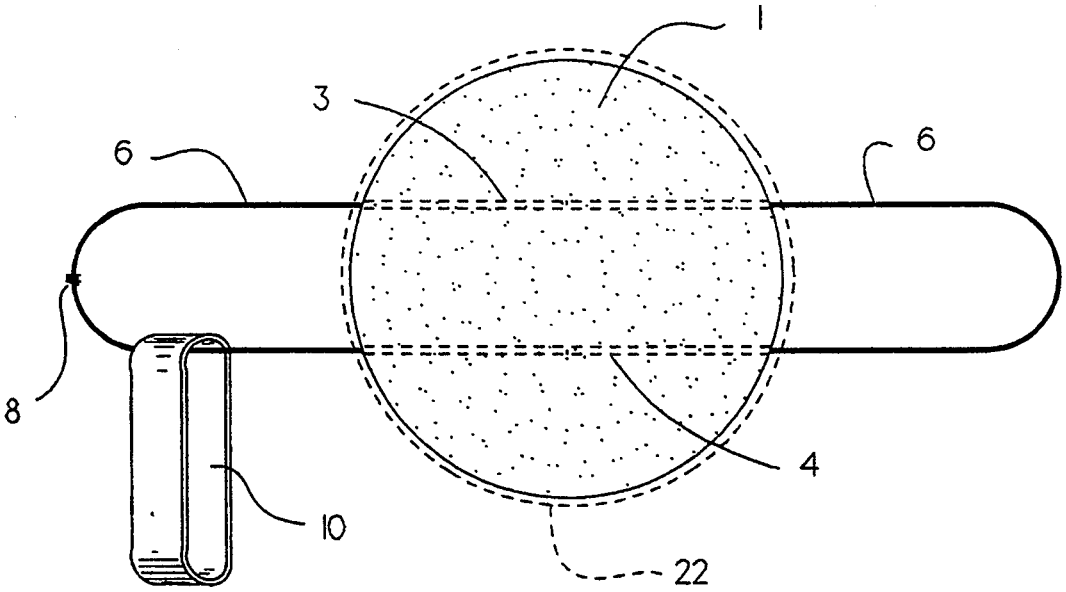
FIG. 1 is a top plan of a present preferred embodiment of my shoulder support.
Figure 2:
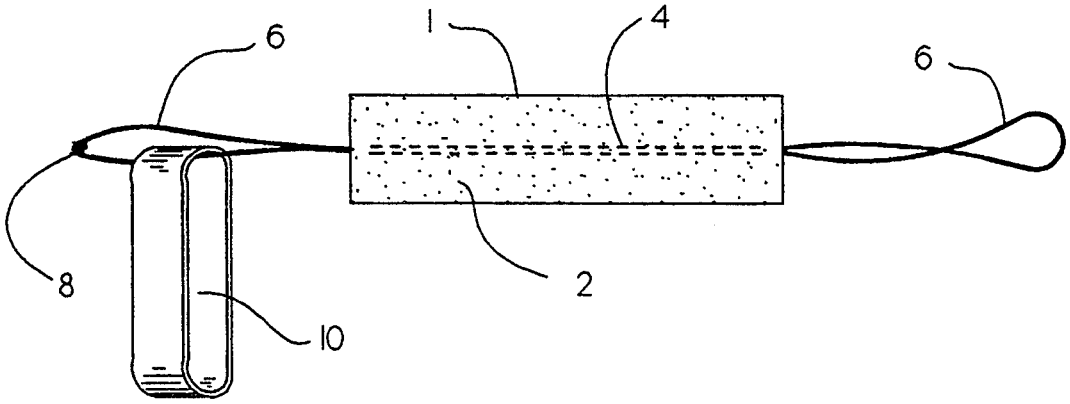
FIG. 2 is a side view of the embodiment of FIG. 1.

Referring to FIG. 1, the present invention is comprised of a foam Dad 1 preferably comprised of an open cell foam material having a high coefficient of friction of from 6 pounds to 30 pounds. I prefer to use a natural latex material preferably between 3 to 4 inches in diameter. The pad is preferably cylindrical such that the thickness 2 of the pad is between 0.125 and 1 inch. For any given material the cellular structure can be altered to change the coefficient of friction achieved when the foam pad is pulled across the smooth wooden surface of a violin or viola.

A pair of longitudinal channels or bores 3 and 4 extend through the foam pad 1. These channels are shown to be substantially parallel but could be otherwise oriented. An inelastic filament 6 passes through the longitudinal channels. Preferably the filament is a monofilament fishing line which is knotted at knot 8 to form the loop. Because it is thin and transluscent the filament loop is; barely visible to the audience. Finally, an elastic band 10 is linked at one end of the filament loop 6.

Although the ends of the filament could be permanently bonded, I prefer to knot them. Should the elastic band 10 break, the musician can easily replace it by untying the knot 8. For the filament loop one could also use a relatively large self locking plastic tie or similar device. This type of tie is conventionally used for bundling cable and has a lock end through which the opposite end extends.

Although the shoulder support can be made in a variety of shapes and sizes, I prefer to use a cylindrical pad 3 inches in diameter and $\frac{3}{4}$ or $\frac{3}{8}$ inches thick. The inelastic loop passes through longitudinal channels spaced about one inch apart. For a violin the inelastic loop is sized to extend about $1\frac{1}{2}$ inches from either side of the pad and an elastic band about $1\frac{1}{4}$ inches in diameter is used.

I prefer to use an elastic foam rubber material such as pure natural latex foam. However, a variety of elastic or slow recovery foams could be used. For example, polyurethane and polyvinyl chloride foams will work. The foam material should not be hard because pads made from hard foams are uncomfortable and will easily slide along the filament. The pad could also have a covering, a second layer or coating of a different material on one surface or encompassing the pad as indicated by portion 22 shown in dotted line in FIG. 1.

Figure 3:
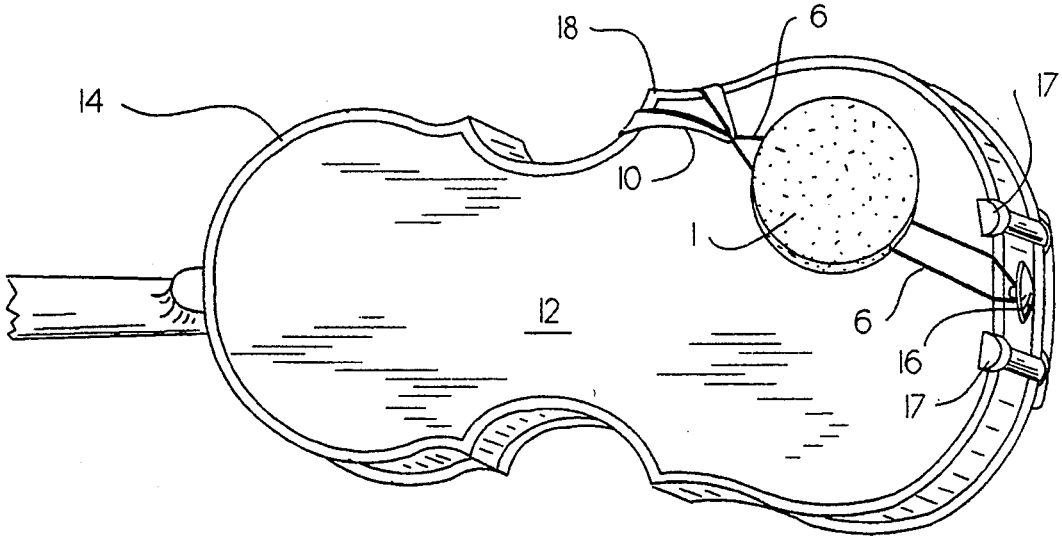
FIG. 3 is a perspective view showing my shoulder support positioned on the back of a violin.
Figure 4:
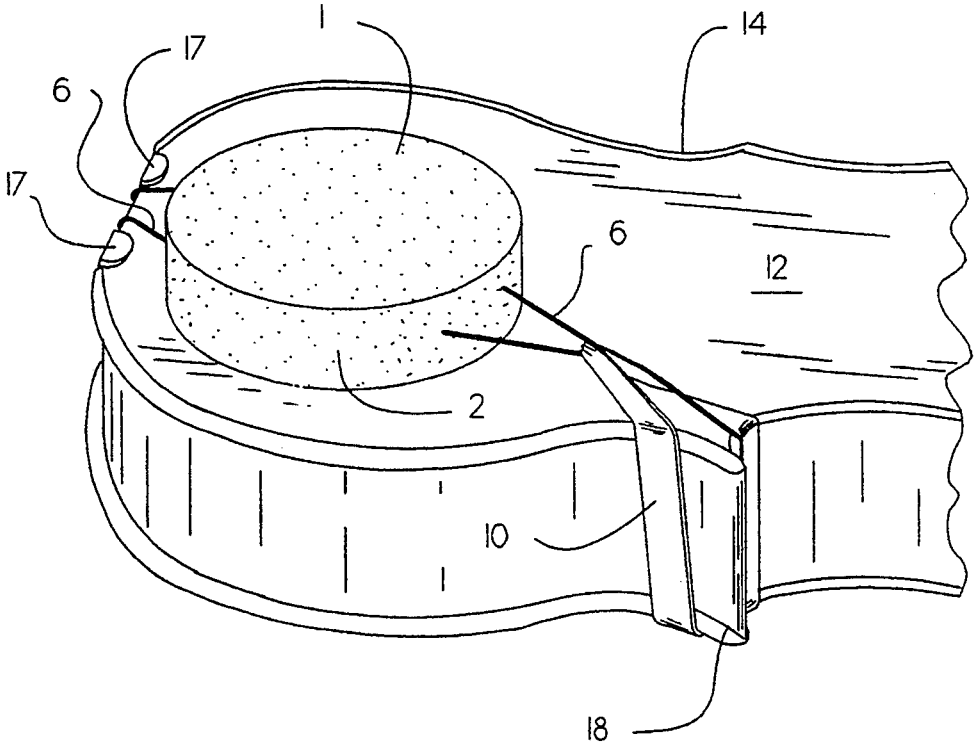
FIG. 4 is a perspective view similar to FIG. 3 showing my shoulder support on a violin.

Referring to FIGS. 3 and 4, the shoulder support is positioned over the back 12 of a stringed instrument such as violin 14. The inelastic filament 6 is looped around end button 16 of the instrument and passes between chin rest clamps 17 as necessary. These clamps are not part of a violin itself, but hold the chin rest onto the violin. The style and placement of clamps can vary widely depending upon chin rest style. Chin rests are used by virtually all classically trained players. The present shoulder pad can fie installed regardless of what style of chin rest clamp is used. If the instrument lacks the traditional end button, other attachment points such as one of the chin rest clamps 17 may be found. The elastic band 10 is fitted over the lower bout corner 18 on the bass-bar side of the instrument. The elastic band causes the foam pad 1 to be pressed against the back of the instrument. In addition, tension of the elastic band acting on the filament tends to force the portions of the filament within the foam pad to be pushed together. This causes a slight compression of the pad between those portions of the filament and increases the friction between the pad and the filament. As a consequence, the pad is prevented from lateral movement along the filament during normal use. The securing friction caused by downward pressure of the filament pressing the pad against the back of the instrument also inhibits travel of the pad across the bottom of the instrument. Nevertheless, the musician may adjust the position of the pad by manually sliding the pad along the filament loop when the instrument is not in a playing position. An elastic filament is not acceptable because it will not produce the same forces on the foam pad which prevent the pad from moving. However, there may be some visoelastic materials that could be used for the filament and produce the same results.

Although I have shown a present preferred embodiment of my invention, several variations could be made. One could change the shape or thickness of the pad. The length of the filament loop could be adjusted as desired. That way, a single pad could be used for both the violin and the viola. This would also permit adjustment of the support for non-standard sized instruments and possibly allow for use on unconventional instrument styles.

The combination of the inelastic loop through the foam pad coupled with the elastic band extending over the lower bout corner of the instrument provides a secure support which is also adjustable. The foam pad also can conform to and grip the player's shoulder giving an extra measure of security. The materials used for this support and the method of attachment preclude damage to the instrument as the materials are softer than the instrument's wood and the attachment points are strong structural elements of the instrument.

The invention is small with no rigid parts and, therefore, may be stored easily in any instrument case. In some model cases the support may even be safely left on the instrument when the instrument is put away. The invention's flexibility also minimizes the dangers inherent in rigid supports, as natural head and shoulder motions are still allowed while playing, reducing the possibility of playing position related injury. The small mass of the foam pad adds virtually no weight to the instrument. The invisibility of the filament and the insignificance of the elastic band together with the method of attachment combine to make a support that is not visually distracting to an audience.

My shoulder support is made of simple, washable components. It can be easily cleaned by the musician to remove perspiration, make-up or dirt that may have accumulated on the foam pad.

Although I have illustrated and disclosed certain present preferred embodiments of my invention, it should be distinctly understood that the invention is not limited thereto, but may be variously embodied within the scope of the following claims.

I claim:

1. A shoulder support for a violin and other stringed instruments having a back, an end button and a lower bout corner on a bass-bar side of the instrument comprising:

a) a foam pad having a pair of longitudinal channels therethrough, the pad made from a resilient foam material which when placed on a violin will have a coefficient of friction so that the pad will remain in place during normal use;

b) an elastic band; and c) a filament loop passing through the elastic band and the pair of longitudinal channels in the foam pad;

wherein the elastic band and filament loop are made from materials and sized so that when the foam pad is placed on the back of the instrument the filament loop may be fitted over an end button on the instrument and the elastic band may be fitted over the lower bout corner on the bass-bar side of the instrument, and when so placed the filament loop will press the pad against the back of the instrument and the portions of the filament within the longitudinal channels of the foam pad will be forced toward one another thereby compressing a portion of the foam pad between the longitudinal channels.

2. The shoulder pad of claim 1 wherein the foam pad is comprised of a substantially open cell foam.

3. The shoulder support of claim 1 wherein the foam pad is comprised of at least two layers of different materials.

4. The shoulder pad of claim 1 also comprising a cover fitted over at least a portion of the foam pad.

5. The shoulder support of claim 1 wherein the foam pad has a thickness of between 0.125 and 1 inch.

6. The shoulder support of claim 1 wherein the foam pad is foam rubber.

7. The shoulder support of claim 1 wherein the foam pad is cylindrical.

8. The shoulder pad of claim 1 wherein the filament loop is fishing line having a rating of at least 30 pounds.

9. The shoulder support of claim 1 wherein the filament loop is inelastic.

10. The shoulder support of claim 1 wherein the longitudinal channels are substantially parallel.

11. The shoulder support of claim 1 wherein the shoulder support is attached to one of a violin and another stringed instrument.

12. The shoulder support of claim 11 wherein the one of a violin and another stringed instrument has a pair of chin rest clamps and the filament loop passes between the pair of chin rest clamps.

13. The shoulder support of claim 11 wherein the one of a violin and another stringed instrument has no chin rest clamps.

14. The shoulder support of claim 11 wherein the one of a violin and another stringed instrument has at least one chin rest clamp and the filament loop is fitted over the at least one chin rest clamp.

15. The shoulder support of claim 11 wherein the one of a violin and another stringed instrument has no end button.

16. The shoulder support of claim 1 wherein the coefficient of friction has a value of from 6 pounds to 30 pounds.

* * * * *